US007905353B2

(12) United States Patent
Baker et al.

(10) Patent No.: US 7,905,353 B2
(45) Date of Patent: Mar. 15, 2011

(54) STACKABLE CONTAINMENT TRAYS AND CASES WITH SLIDE LATCHES

(75) Inventors: Terry L. Baker, Boggstown, IN (US); Rebecca Baker, Boggstown, IN (US)

(73) Assignee: Greatbatch Ltd., Clarence, NY (US)

( * ) Notice: Subject to any disclaimer, the term of this patent is extended or adjusted under 35 U.S.C. 154(b) by 1030 days.

(21) Appl. No.: 11/725,532

(22) Filed: Mar. 19, 2007

(65) Prior Publication Data

US 2008/0000899 A1 Jan. 3, 2008

Related U.S. Application Data

(60) Provisional application No. 60/818,207, filed on Jun. 30, 2006.

(51) Int. Cl.
*B65D 21/00* (2006.01)

(52) U.S. Cl. ..... 206/370; 206/503

(58) Field of Classification Search ..... 206/363, 206/370, 438, 503, 508, 509, 368, 369; 422/297, 422/300, 301, 310

See application file for complete search history.

(56) References Cited

U.S. PATENT DOCUMENTS

| | | | | |
|---|---|---|---|---|
| 144,343 | A | 11/1873 | Martin | |
| 568,122 | A | 7/1897 | Gale | |
| 1,542,115 | A | 6/1925 | Weis | |
| 2,540,940 | A | 2/1951 | Ganzer | 312/168 |
| 2,944,694 | A | 7/1960 | Kinsey | 220/17 |
| 3,589,554 | A | 6/1971 | Smith | 220/23.83 |
| 3,635,361 | A | 1/1972 | Hayes | 214/10.5 R |
| 3,780,468 | A | 12/1973 | Maffett | 43/54.5 R |
| 3,939,982 | A | 2/1976 | Russell | 206/509 |
| 4,661,326 | A | 4/1987 | Schainholz | 422/310 |
| 4,728,504 | A | 3/1988 | Nichols | 422/297 |
| 4,799,604 | A | 1/1989 | Okojima et al. | 220/260 |
| 4,832,200 | A | 5/1989 | Deaton et al. | 206/508 |
| 4,915,913 | A | 4/1990 | Williams et al. | 422/119 |
| 4,981,224 | A | 1/1991 | Rushing | 211/126 |
| 5,285,900 | A * | 2/1994 | Swingler | 206/508 |
| 5,384,103 | A | 1/1995 | Miller | 422/310 |
| 5,415,846 | A | 5/1995 | Berry, Jr. | 422/97 |
| 5,424,048 | A | 6/1995 | Riley | 422/300 |
| 5,441,707 | A | 8/1995 | Lewis et al. | 422/300 |
| 5,540,901 | A | 7/1996 | Riley | 422/300 |
| 5,544,969 | A | 8/1996 | Ammon et al. | 403/322 |
| 5,628,970 | A | 5/1997 | Basile et al. | 422/297 |
| 5,641,065 | A | 6/1997 | Owens et al. | 206/370 |
| 5,706,968 | A | 1/1998 | Riley | 220/326 |
| 5,887,745 | A | 3/1999 | Wood | 220/326 |
| 5,890,613 | A | 4/1999 | Williams | 220/23.4 |

(Continued)

OTHER PUBLICATIONS

International Search Reported dated Sep. 18, 2008 from PCT/US07/71087, 3 pgs.

*Primary Examiner* — Jacob K Ackun, Jr.
(74) *Attorney, Agent, or Firm* — Michael F. Scalise

(57) ABSTRACT

A stackable containment tray for receiving discrete articles for storage and/or sterilization according to one embodiment of the present invention comprises a combination of two side panels, a floor supported by the two side panels, an upper stack ring, and a lower stack ring, a pair of opposed handle lock brackets, and a pair of opposed bail handles. The upper and lower stack rings are identical to each other and provide the stacking capability. The bail handle of one tray is able to interfit into the handle lock bracket of an upper tray, thereby enabling the stacked combination of trays to be locked together.

23 Claims, 22 Drawing Sheets

U.S. PATENT DOCUMENTS

| | | | | |
|---|---|---|---|---|
| 6,012,577 | A | 1/2000 | Lewis et al. | 206/370 |
| 6,116,452 | A | 9/2000 | Hamel et al. | 220/318 |
| 6,138,850 | A | 10/2000 | Berry, III | 220/4.28 |
| 6,508,495 | B1 | 1/2003 | Riley | 292/152 |
| 6,554,327 | B1 | 4/2003 | Riley | 292/152 |
| 6,592,000 | B1 | 7/2003 | Owens et al. | 220/324 |
| 6,783,004 | B1 | 8/2004 | Rinner | 206/368 |
| 6,868,970 | B2 | 3/2005 | Gardiner et al. | 206/725 |
| 6,874,634 | B2 * | 4/2005 | Riley | 206/439 |
| 6,896,149 | B1 | 5/2005 | Berry, III | 220/4.28 |
| 6,991,108 | B1 | 1/2006 | Rorato et al. | 206/503 |
| 7,021,485 | B1 | 4/2006 | Baker et al. | 220/326 |
| 7,699,212 | B2 * | 4/2010 | Turvey et al. | 229/117.02 |
| 2002/0071799 | A1 | 6/2002 | Wood | 422/300 |
| 2002/0079313 | A1 | 6/2002 | Grayson | 220/23.4 |
| 2002/0179701 | A1 * | 12/2002 | Bazany et al. | 229/199 |
| 2004/0118742 | A1 * | 6/2004 | Shuert | 206/600 |
| 2004/0144670 | A1 * | 7/2004 | Riley | 206/370 |
| 2005/0109775 | A1 | 5/2005 | Meissen | 220/23.6 |
| 2006/0071002 | A1 | 4/2006 | Hurst | 220/345.1 |
| 2006/0191943 | A1 | 8/2006 | Dane et al. | 220/501 |
| 2006/0266666 | A1 | 11/2006 | Bettenhausen et al. | 206/370 |

* cited by examiner

STACKABLE CONTAINMENT TRAYS AND CASES WITH SLIDE LATCHES

CROSS REFERENCES TO RELATED APPLICATIONS

The present application is a Continuation-In-Part patent application of and claims the benefit of U.S. Provisional Patent Application Ser. No. 60/818,207, filed Jun. 30, 2006, entitled "Stackable Containment Trays" which is hereby incorporated by reference in its entirety.

BACKGROUND OF THE INVENTION

The present invention pertains in general to stackable containment trays and cases that can be used for medical and dental equipment, devices, and instruments. Included as part of the case construction is a closing lid that includes novel slide latches. These stackable containment trays and cases can be used during autoclaving and for storage after proper sterilization. Each tray has a construction comprised of various component parts that are preferably riveted together and, when a removable closing lid is added, a containment tray becomes a containment case. The slide latches secure the closing lid to the uppermost tray of the stack of trays or to the single tray.

More specifically, the present invention pertains to the use of identical stacking rings wherein one stacking ring is arranged adjacent the upper edge portion of the tray and the other stacking ring is arranged adjacent the lower edge portion of the tray. Additionally, each tray includes a handle lock bracket and spaced therefrom a bail handle. The stackable containment trays are able to be interlocked by positioning the bail handles of the lower tray into the handle lock brackets of the upper, adjacent tray.

Whether for purposes of more efficient storage or for more convenience transport or perhaps for higher capacity sterilization, containment trays and cases can benefit from being stackable. The design considerations and issues then become design simplicity, reliability, and versatility, to mention a few. Another consideration is the stackability of the cases and the degree of ease or difficulty with which the assembled stack can be moved, stored, and autoclaved. There are also situations involving the use and handling of stacked trays or cases that would benefit from the stacked combination being secured together as a single unit. The present invention addresses these considerations and issues in novel and unobvious ways.

BRIEF SUMMARY OF THE INVENTION

A stackable containment tray for receiving discrete articles for storage and/or sterilization according to one embodiment of the present invention comprises a combination of two side panels, a floor supported by the two side panels, an upper stack ring, and a lower stack ring, a pair of opposed handle lock brackets, and a pair of opposed bail handles. The upper and lower stack rings are identical to each other and provide the stacking capability. The bail handle of one tray is able to interfit into the handle lock bracket of an upper tray, thereby enabling the stacked combination of trays to be locked together. Also disclosed is a sliding latch wherein a plurality of latches are attached to a closing lid for securing the lid to a tray.

One object of the present invention is to provide improved stackable containment trays and cases.

Related objects and advantages of the present invention will be apparent from the following description.

DETAILED DESCRIPTION OF THE INVENTION

Figure 1:
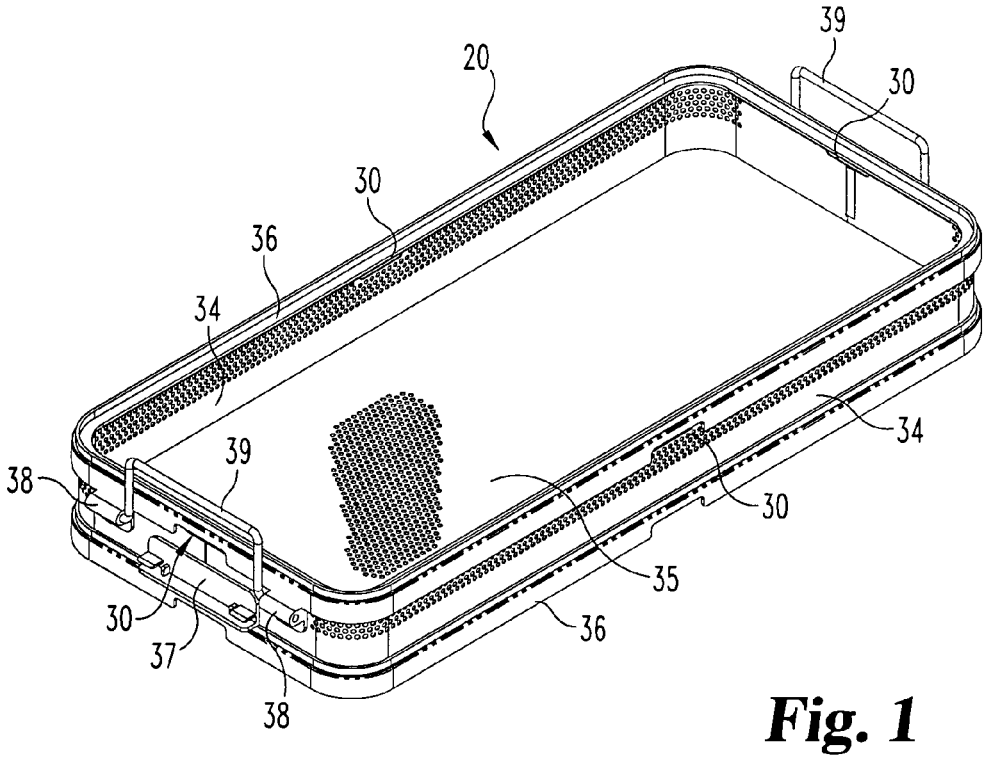
FIG. 1 is a perspective view of an assembled containment tray according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
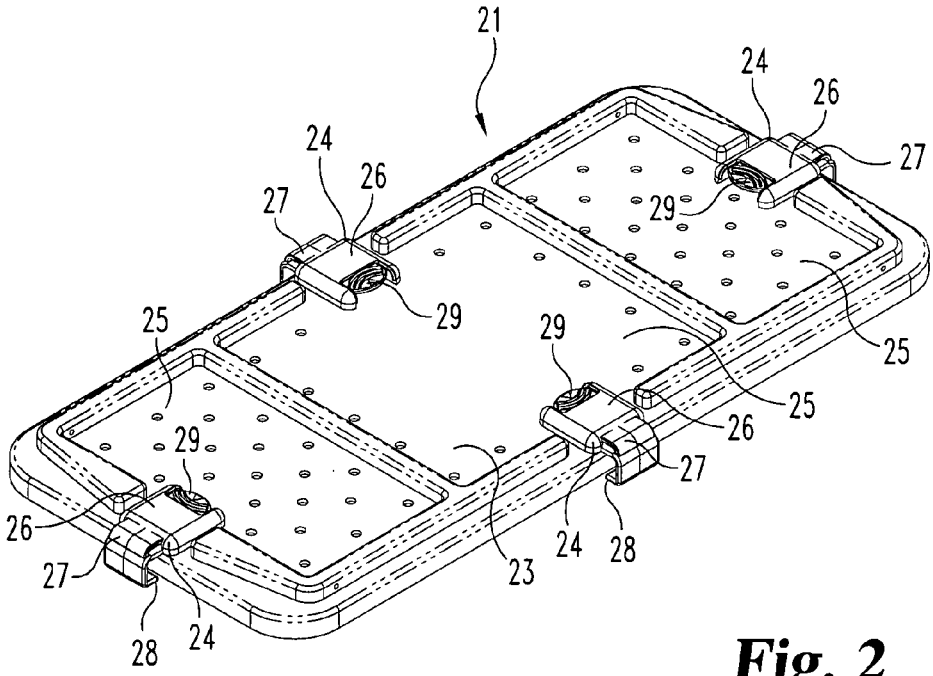
FIG. 2 is a perspective view of a closing lid suitable for connection to the FIG. 1 containment tray.
Figure 3:
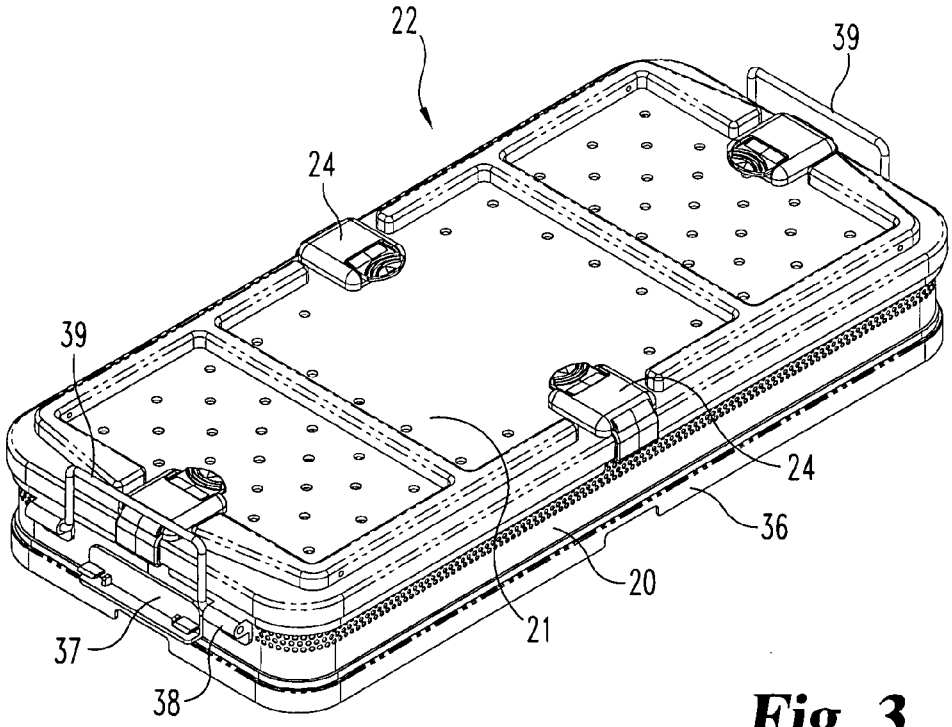
FIG. 3 is a perspective view of the FIG. 2 closing lid assembled onto the FIG. 1 containment tray.

Referring to FIGS. 1, 2 and 3, there is illustrated a containment tray 20 that is constructed and arranged according to the present invention. A suitable closing lid 21 for tray 20, in order to thereby create a containment case 22 (see FIG. 3), is illustrated in FIG. 2. Closing lid 21 includes a generally rectangular, vacuum-formed plastic body 23 and four slide latches 24. Each slide latch 24 is securely attached to an upper surface 25 of the body 23 adjacent one of its four sides by the use of mounting spuds in cooperation with a matching hole pattern in the upper surface at each slide latch 24 location. Each hole is countersunk from the back side or inner surface of the lid 21. Upper surface 25 defines a plurality of flow holes for the passage of steam and/or other sterilant. Each slide latch 24 includes a body 26 that is attached to surface 25 and a slide member 27 that moves through the body 26 toward and away from body 23. The position of slide lip 28 can be controlled by the manual engagement and movement of slide button 29. As will be described, the mating tray 20 includes corresponding and aligned openings, four total (see FIG. 1), that are constructed and arranged to receive the lip 28 of the mating slide latch 24. This mechanical engagement securely attaches the lid 21 to the tray 20 in order to create containment case 22.

With continued reference to FIG. 1, the fully assembled containment tray 20 is a combination of individual component parts that are separately fabricated and then assembled together to create the tray 20 construction that is illustrated. The component parts of tray 20 are illustrated in FIGS. 4-9 and include two side panels 34, a floor 35, two unitary plastic stack rings 36, two handle lock brackets 37, four bail handle sockets 38, and two wire bail handles 39. The two side panels 34 are arranged to face each other and the floor is received therein. One stack ring 36 is at or adjacent the base or bottom of the tray and in cooperation with the corresponding side panel supports the edge of floor 35. The other stack ring 36 is at or adjacent the open upper end of the tray for receiving lid 21. One handle lock bracket 37 is attached at one end of tray 20 and the other handle lock bracket 37 is attached in a similar and aligned fashion at the opposite end of the tray 20. Two bail handle sockets 38 are attached in a spaced-apart manner at one end of the tray and are arranged to receive one of the two wire bail handles 39. Each bail handle 39 is able to be flexed so as to shorten the distance between its free ends 39*a* and 39*b*. This in turn permits the free ends of the bail handle to be inserted into the corresponding spaced pair of bail handle sockets 38. The other two bail handle sockets 38 are attached at the opposite end of tray 20 in a similar and aligned fashion. The other wire bail handle 39 is assembled into this opposite pair of sockets 38 in the same fashion.

As described herein, the attachment of the pair of side panels 34 via the lower stack ring 36 and/or the upper stack ring 36, creates a tray frame with two sides and two ends. Each end includes one section 42*a* and one section 42*b* and receives one handle lock bracket and one bail handle 39 with sockets 38.

The preferred material for each side panel 34 is metal and the preferred fabrication method or technique is a metal stamping operation followed by a forming or bending operation. The preferred material for floor 35 is metal and the preferred fabrication method or technique is a metal stamping. The preferred material for each stack ring 35 is plastic and the preferred fabrication method or technique is a molding operation. The preferred material for each handle lock bracket 37 is plastic and the preferred fabrication method or technique is a molding operation. The preferred material for each bail handle socket is plastic and the preferred fabrication method or technique is a molding operation. The preferred material for each wire bail handle 39 is metal and the preferred fabrication method or technique is a bending operation.

As for the overall assembly or fabrication of tray 20, once all of the required components parts are available, the first step is to assemble the floor 35 and the two side panels 34 into a subassembly. Each side panel 34 (see FIG. 4) includes a first end section 42*a* and opposite thereto a second end section 42*b* with an extending or offset rivet flange 43. Each end section 42*a* and 42*b* is substantially flat and generally perpendicular to the side section 42*c*. As would be understood, when the second side panel 34 is turned into a facing orientation with the first side panel, the end sections are reversed such that there is an offset rivet flange at each end of the tray being assembled. Further, the joining of the two end sections, one from each side panel 34, creates each end of the tray. Each side panel 34 further includes a floor-support flange 44*a* along the length and a floor-support flange 44*b* along each width side. With the two side panels facing each other, but not yet connected, the floor 35 is positioned onto flanges 44*a* and 44*b* of both side panels. Next, the two side panels 34 are pushed together and riveted to each other at each end using the offset rivet flange 43. Pilot holes, not shown, are drilled for the rivets. The floor is effectively clamped in position by the two side panels (see FIG. 13).

Figure 13:
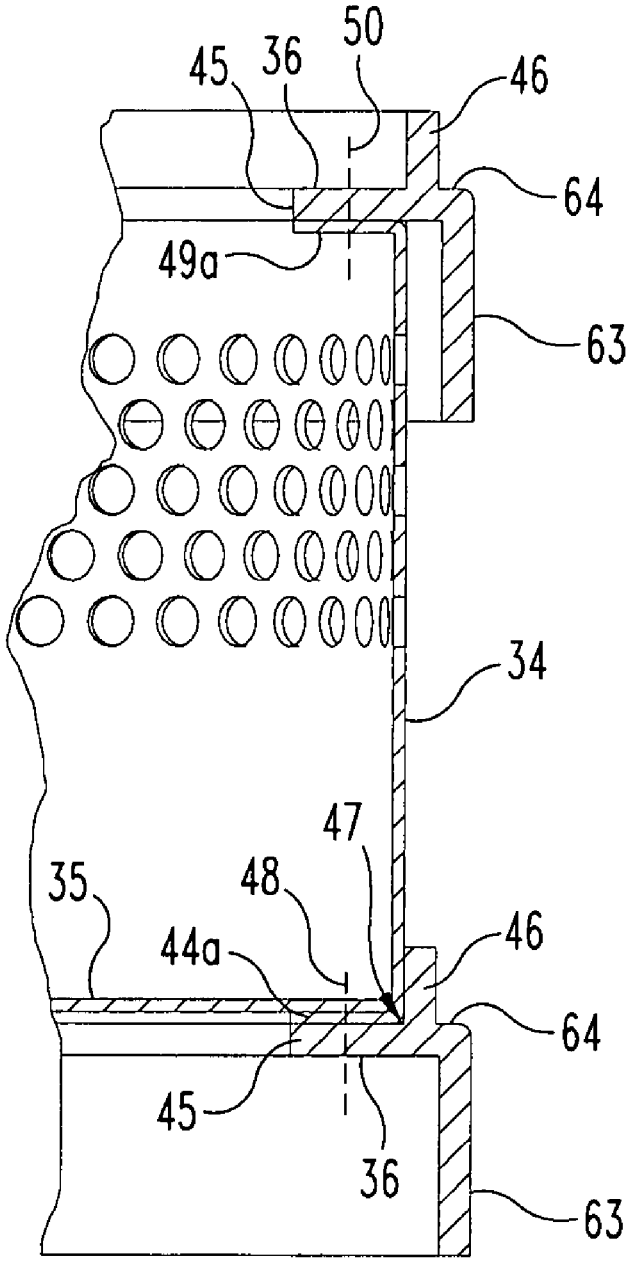
FIG. 13 is a partial, end elevational view, in full section, illustrating the arrangement of components for the FIG. 1 containment tray.
Figure 14:
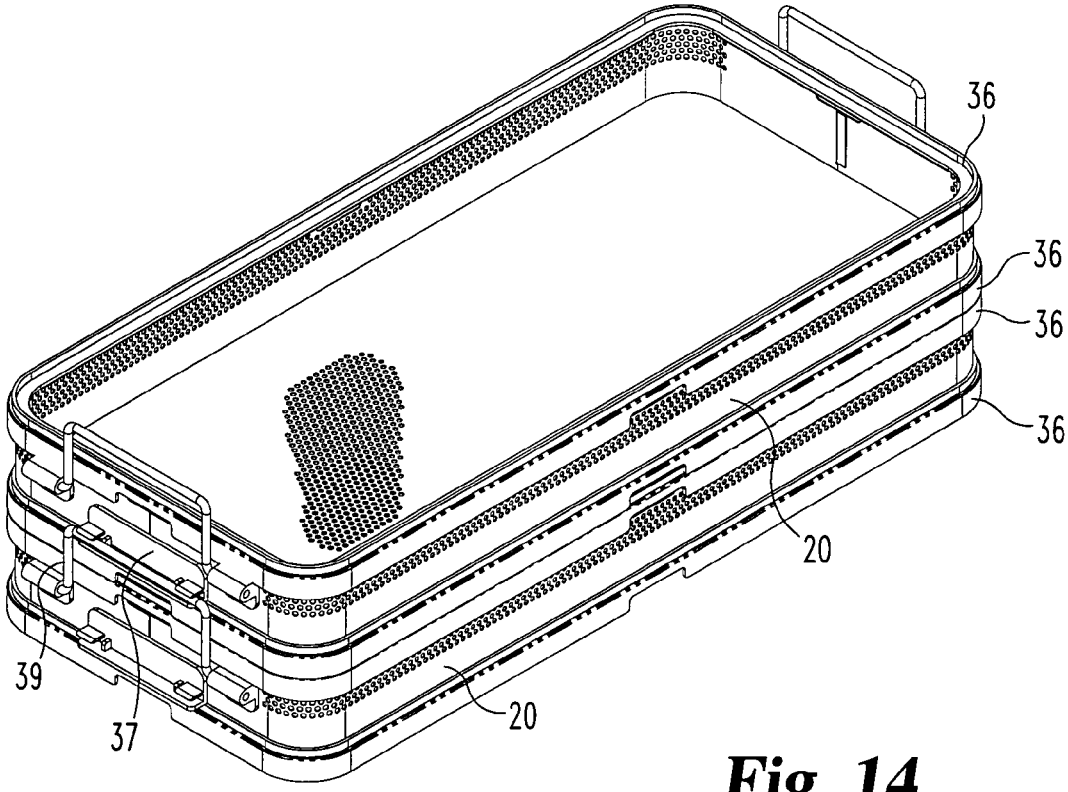
FIG. 14 is a perspective view of two FIG. 1 containment trays stacked together.
Figure 15:
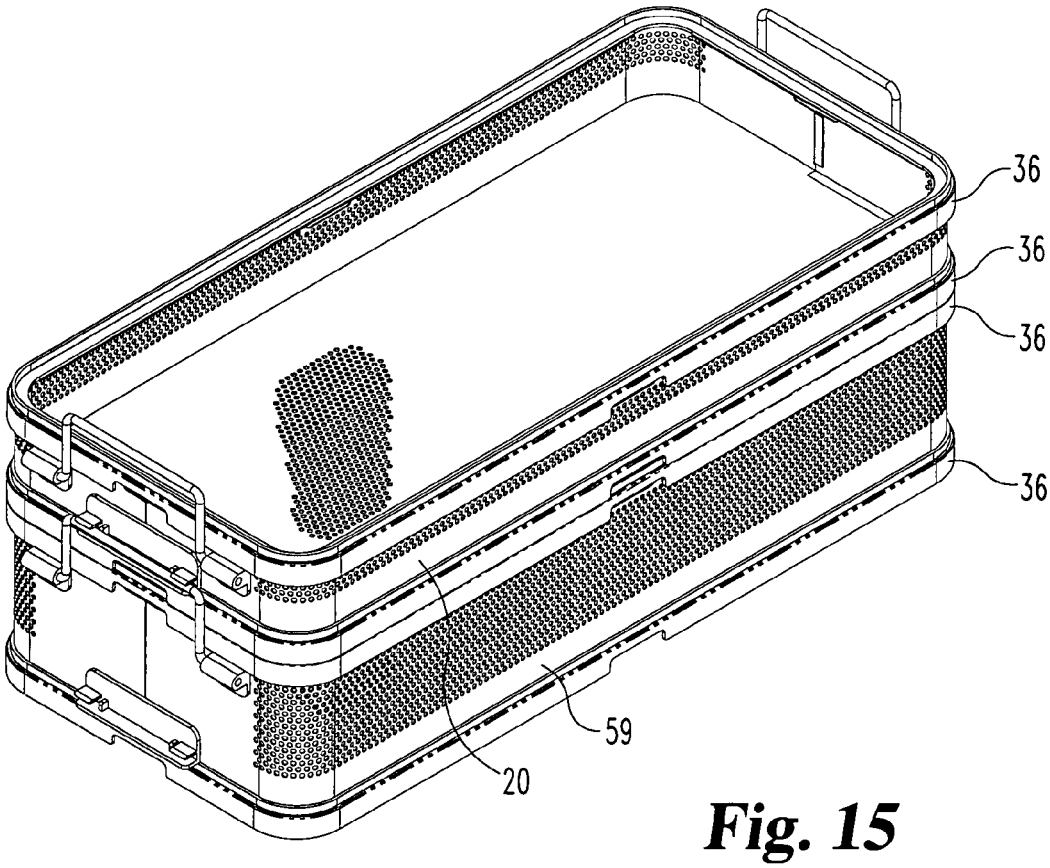
FIG. 15 is a perspective view of one FIG. 11 containment tray stacked together with one FIG. 1 containment tray.
Figure 16:
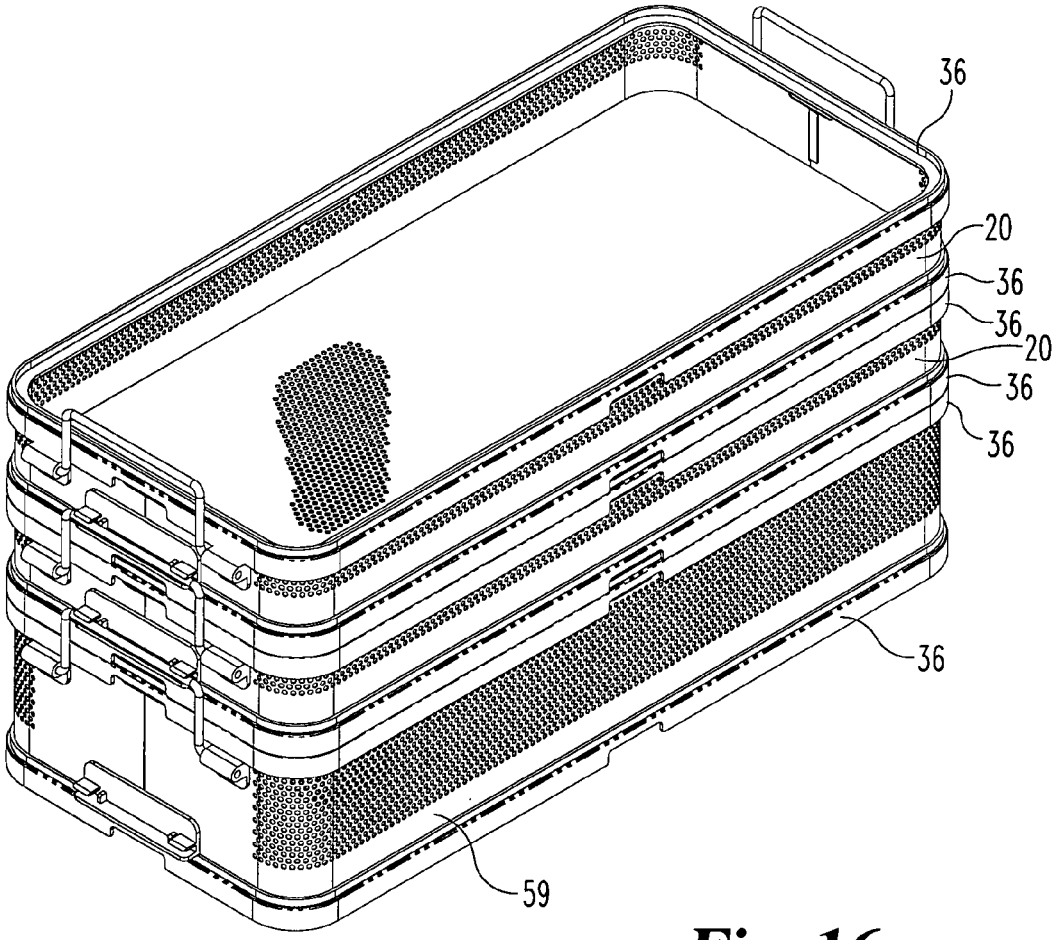
FIG. 16 is a perspective view of one FIG. 11 containment tray stacked together with two FIG. 1 containment trays.
Figure 17:
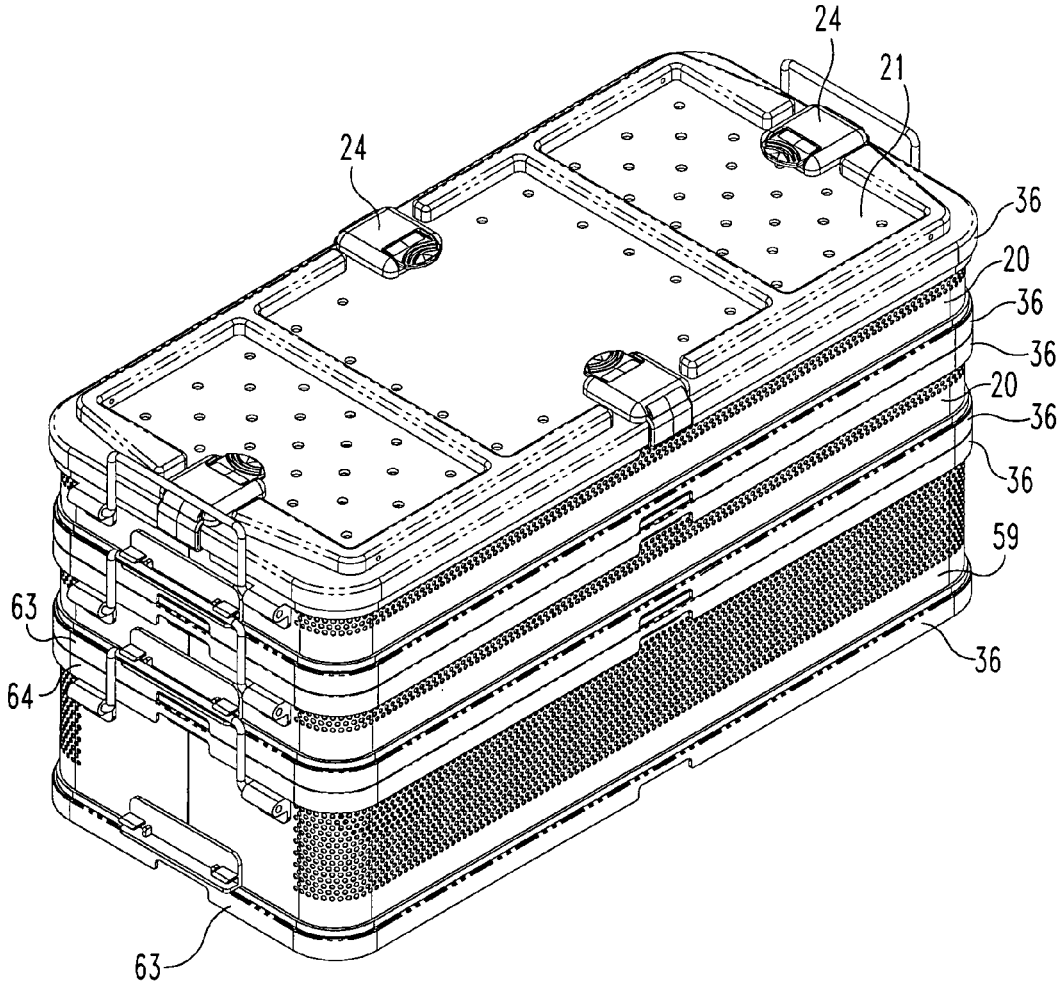
FIG. 17 is a perspective view of the FIG. 16 stacked combination with the FIG. 2 closing lid.

The next step is to take the side panel 34 and floor 35 subassembly and position it on top of the lower stack ring 36 (see FIG. 13). Each stack ring 36 includes an inner support shelf 45 and an upright wall 46. These two portions define an interior right angle corner 47 that receives the corner edge of the corresponding side panel 34 (see FIG. 13). The next step is to securely and tightly rivet together the floor 35 with each side panel 34 and with the corresponding support shelf 45. A suitable riveting location is identified in FIG. 13 by broken line 48. Each stack ring 36 includes opposite end notches 36*a* and opposite side notches 36*b* for clearance so that each slide latch lip 28 can engage each slot 30.

The next step in the assembly procedure is to place the upper stack ring 36 on the upper edges of the side panels 34 such that support shelf 45 rests on the upper flanges 49*a* (of each side section 42*c*) and 49*b* (of each end section 42*a* and 42*b*). These two components are then riveted together, generally at the location defined by broken line 50. Since there is not any reference surface to abut up against or align to, such as the use of corner 47, a removable spacer or shim can be used for proper positioning of the upper stack ring 36. The thickness of the spacer or shim corresponds precisely to the thickness of upright wall 46, as depicted in FIG. 13. This ensures the proper alignment and positioning for future stacking of containment trays.

The next step is to rivet each handle lock bracket 37 to the joined end sections of the two side panels 34. The same approach and technique is applied to each bail handle socket 38. However, due to the stiffness of each bail handle 39, the preliminary step is to insert each end of the bail handle into its corresponding socket 38, prior to riveting or otherwise attaching the sockets 38 (with installed handle) to the end. While riveting is considered to be the preferred connection method due to the anticipated weight of the articles to be placed in the trays and cases, ultrasonic welding is another connection option.

With continued reference to FIG. 1, the assembled containment tray 20 is ready for the receipt of any discrete articles that need to be transported, stored, sterilized, etc. The preferred method of lifting, handling, and transporting is to pivotally raise each bail handle 39, as illustrated, noting that there is sufficient clearance between the bail handle and upper stack ring 36 for the fingers of the user to be inserted, similar to how a basket or tray might be lifted and carried. When not manually raised, the bail handles are free to pivot or drop to a downward or depending (hanging) orientation.

Figure 4:
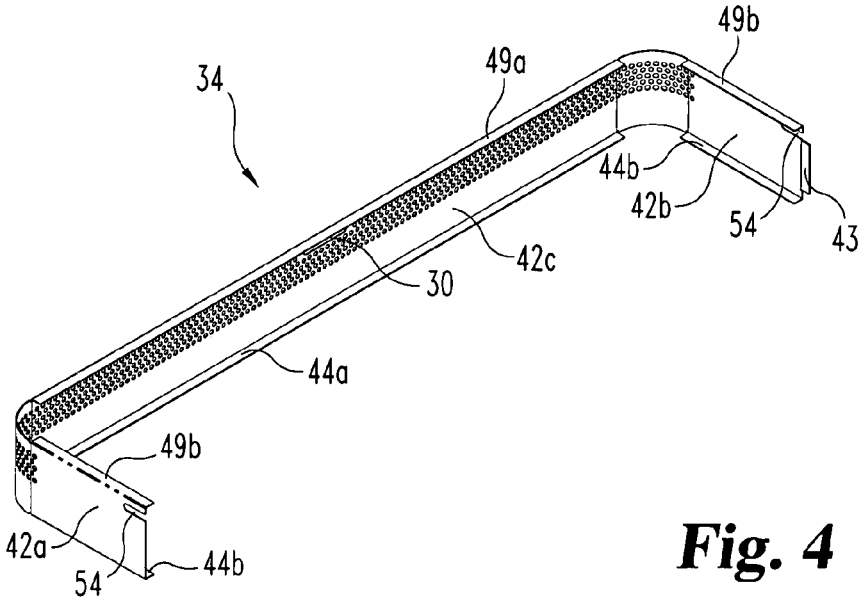
FIG. 4 is a perspective view of a side panel comprising one portion of the FIG. 1 containment tray.
Figure 5:
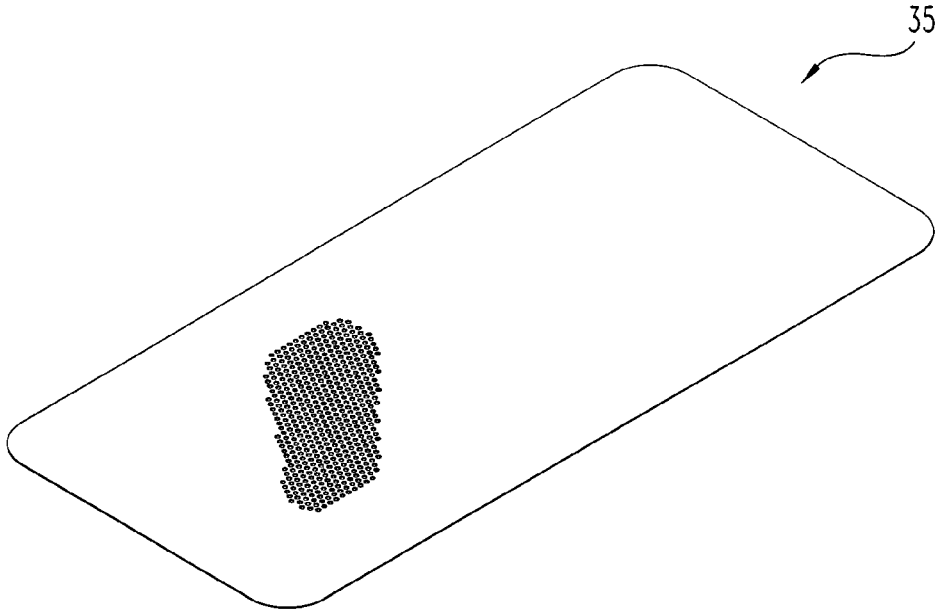
FIG. 5 is a perspective view of a floor comprising one component of the FIG. 1 containment tray.
Figure 6:
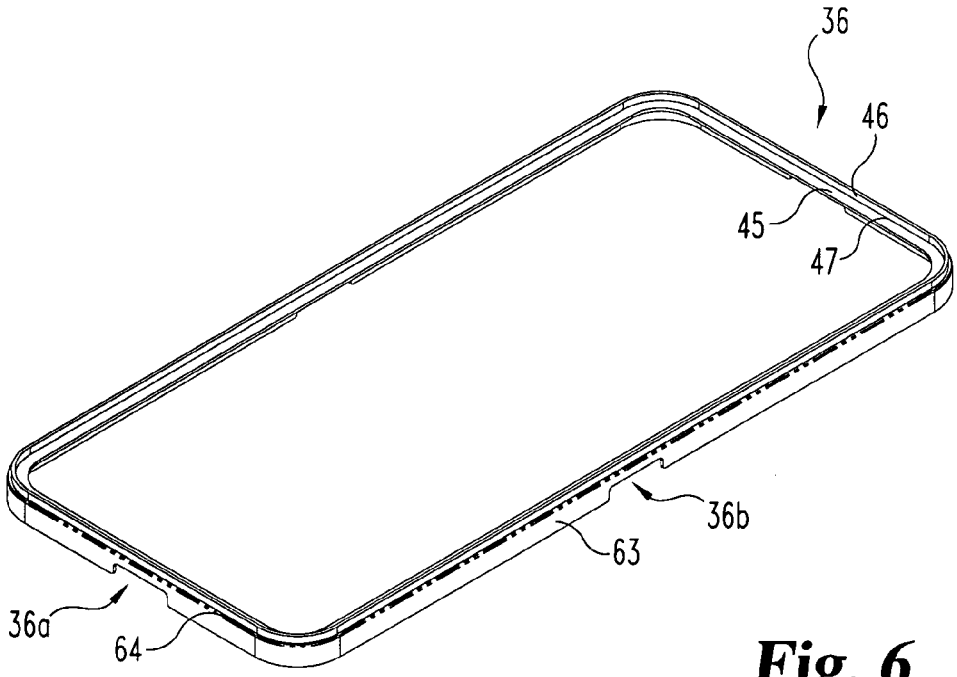
FIG. 6 is a perspective view of a plastic stack ring, two of which are used as part of the FIG. 1 containment tray.
Figure 7:
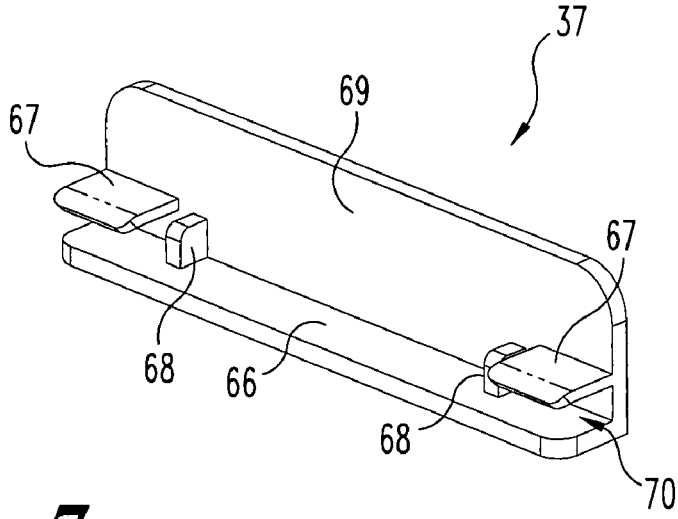
FIG. 7 is a perspective view of a handle lock bracket, two of which are used in the assembly of the FIG. 1 containment tray.
Figure 8:
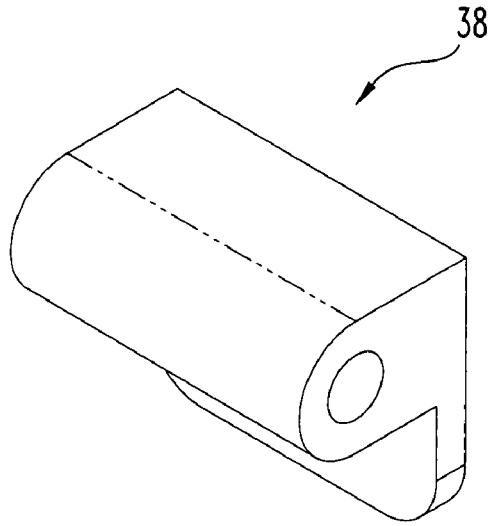
FIG. 8 is a perspective view of a bail handle socket, four of which are used in the assembly of the FIG. 1 containment tray.
Figure 9:
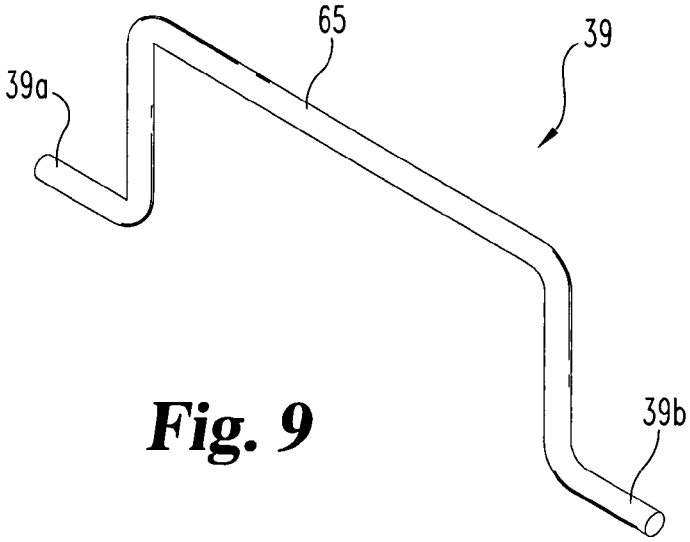
FIG. 9 is a perspective view of a wire bail handle, two of which are used in the assembly of the FIG. 1 containment tray.

With continued reference to FIG. 4, each side panel 34 includes one oblong slot 30 for receipt of a corresponding slide latch lip 28. The end sections 42*a* and 42*b* that provide approximately one-half of the tray's end length each include an approximately one-half length open oblong slot 54. As the two side panels are assembled together, enclosed end slots 30 are created by the mating of facing end sections 42*a* and 42*b* at one end and 42*b* and 42*a* at the opposite end. These end slots are constructed and arranged to receive a corresponding slide latch lip 28 as part of securing the lid 21 to the tray 20 in order to create containment case 22.

Figure 10:
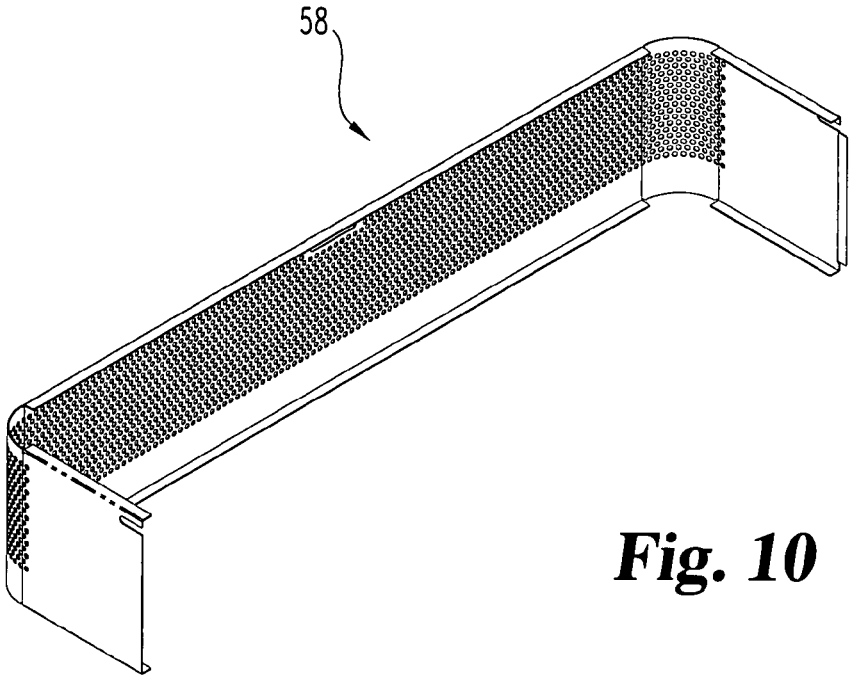
FIG. 10 is a perspective view of a deeper side panel suitable for use in fabricating a containment tray according to the present invention.
Figure 11:
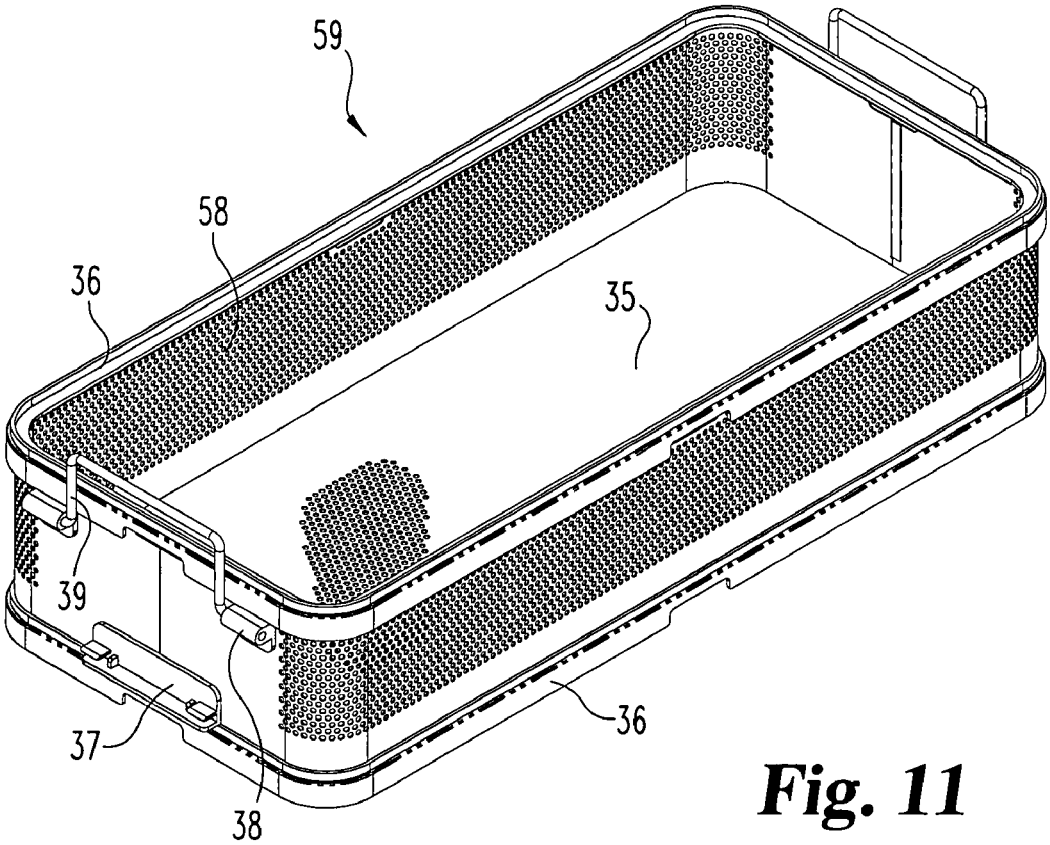
FIG. 11 is a perspective view of a containment tray utilizing two of the FIG. 10 side panels and providing a deeper tray as compared to the FIG. 1 containment tray.
Figure 12:
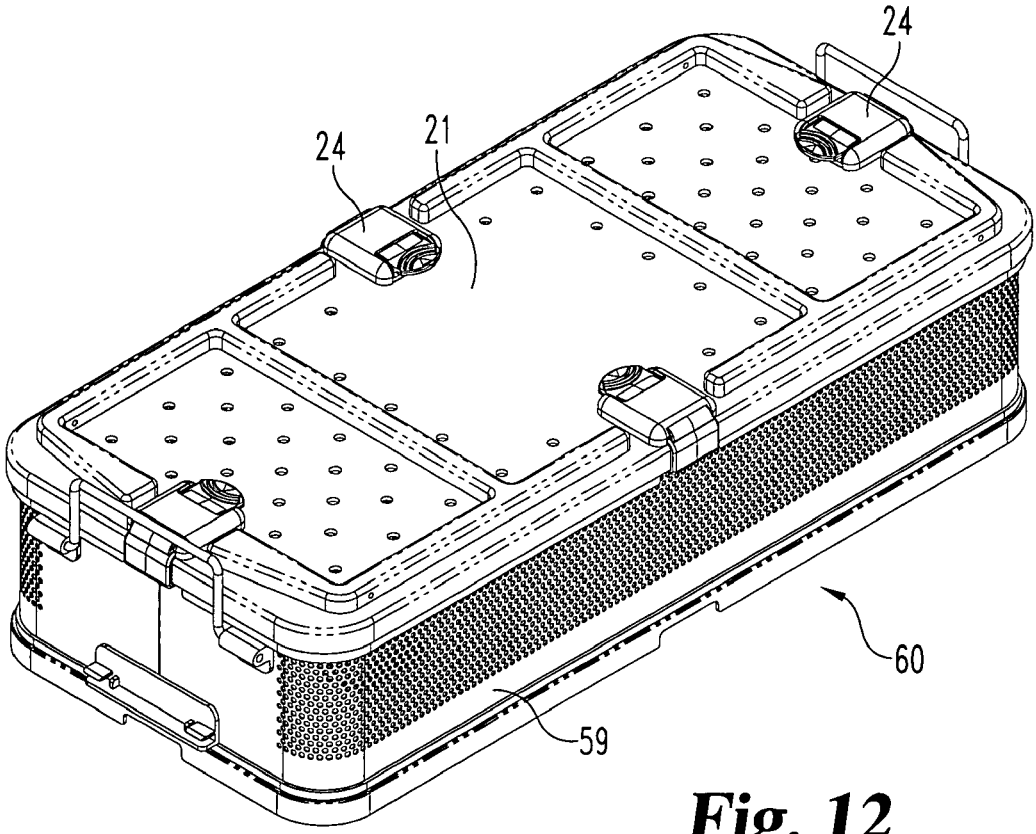
FIG. 12 is a perspective view of the FIG. 11 containment tray with the FIG. 2 closing lid.

One variation for tray 20 of FIG. 1 is to increase the tray depth. This is achieved by designing each side panel 58 with greater (i.e., increased) depth (see FIG. 10). Side panel 58, as illustrated in FIG. 10, is identical to side panel 34 in every respect except for its height or depth. In the preferred embodiment, side panel 58 is approximately twice the depth of side panel 34. The new tray 59 that is created from side panels 58 maintains the same length and width dimensions as tray 20. This permits the deeper tray 59 (see FIG. 11) to use all of the same (other) component parts, changing only the side panels 58. As such, tray 59 uses the same floor 35, the same plastic stack rings 36, the same handle lock brackets 37, the same bail handle sockets 38, and the same wire bail handles 39. Further, the same assembly technique and method is used for the assembly of these component parts in order to create tray 59. Further, the same closing lid 21 is able to be used on tray 59 in order to create containment case 60, as illustrated in FIG. 12.

One of the features of the present invention is the ability to stack one tray one top of another tray and the ability to add a closing lid to the top tray in the stack in order to create a case. This stackable capability is derived from the specific shape of each plastic stack ring 36 wherein the depending outer wall 63 of the upper tray rests on outer support shelf 64 of the lower tray up against upright wall 46. Inner support shelf 45 and outer support shelf 64 are on opposite sides of upright wall 46. Inner support shelf 45 and outer support shelf 64 are coplanar and are perpendicular to upright wall 46 and to depending outer wall 63. The distance between the outer surface of wall 46 and the outer surface of wall 63 is substantially equal to the thickness of wall 63. The cross sectional illustration of FIG. 13 depicts the stack ring 36 geometry that permits a lower stack ring of one tray to fit onto an upper stack ring 36 of the adjacent tray. This stackable feature capability is not limited to any particular number of trays and it is not limited to the depth of the trays that are selected for the stack. Trays 20 and 59 can be mixed in the stack in any number and in any order. The only practical limitation as to the number of trays depends on the articles to be placed within each tray and the overall combined weight of the stacked trays with the articles placed therein. As noted, a closing lid 21 can be used on the top tray of the stack and various examples of stacked tray arrangements or combinations are illustrated in FIGS. 14-17.

Figure 18:
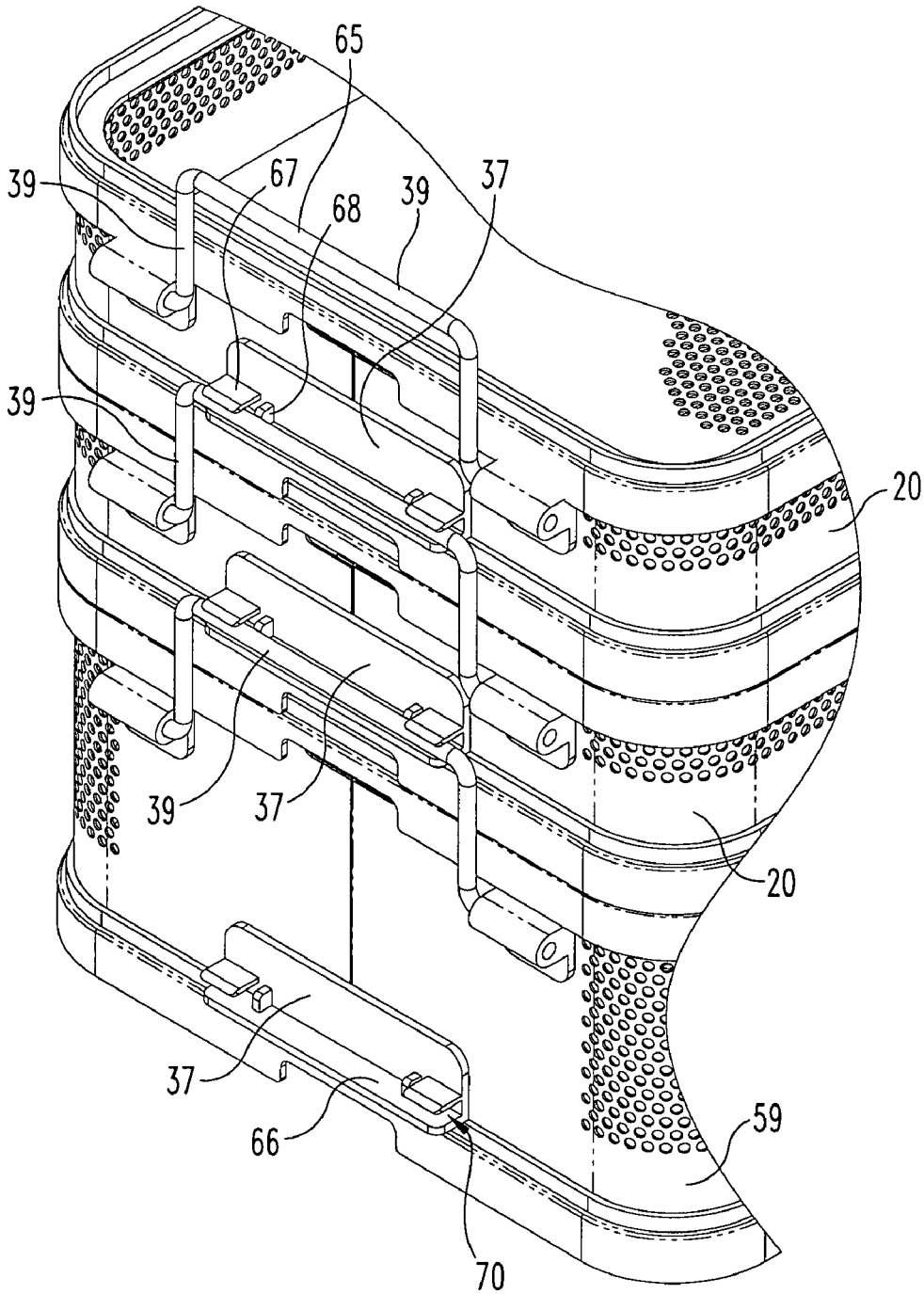
FIG. 18 is a partial perspective view of the FIG. 16 stacked combination.

Another feature of the present invention is the ability to effectively lock the stacked trays together, as detailed in FIG. 18 and as illustrated in FIGS. 14-17. This locking feature involves pivoting a bail handle 39 of a lower tray upwardly into the handle lock bracket 37 of the immediately upper or adjacent stacked tray. The center portion 65 of the bail handle has a wire diameter that allows it to fit snugly into the clearance channel 70 that is defined by the combination of shelf 66 and the two spaced-apart detent tabs 67. The pair of gusset protrusions 68 that are illustrated prevent pushing the bail handle 39 too far inwardly. This in turn spaces the bail handle away from the back panel 69 of the handle lock bracket 37 a sufficient distance (i.e., spacing) so that it is easy to grasp the bail handle 39 and pull it in a direction away from the end of the tray so as to disengage the bail handle from its engaged or locked position within the corresponding handle lock bracket 37. Although this engagement of bail handles 39 into a corresponding and cooperating handle lock bracket 37 is only illustrated at one end of the stacked tray arrangement, it is to be understood that a similar arrangement exists at the opposite end so as to prevent separation of the stacked trays, even partially. In order to avoid critical dimensions and tolerancing, the use of plastic for the handle lock brackets 37 provides some "give" in terms of slight movement or deflection permitted for each of the spaced-apart detent tabs 67.

Figure 19:
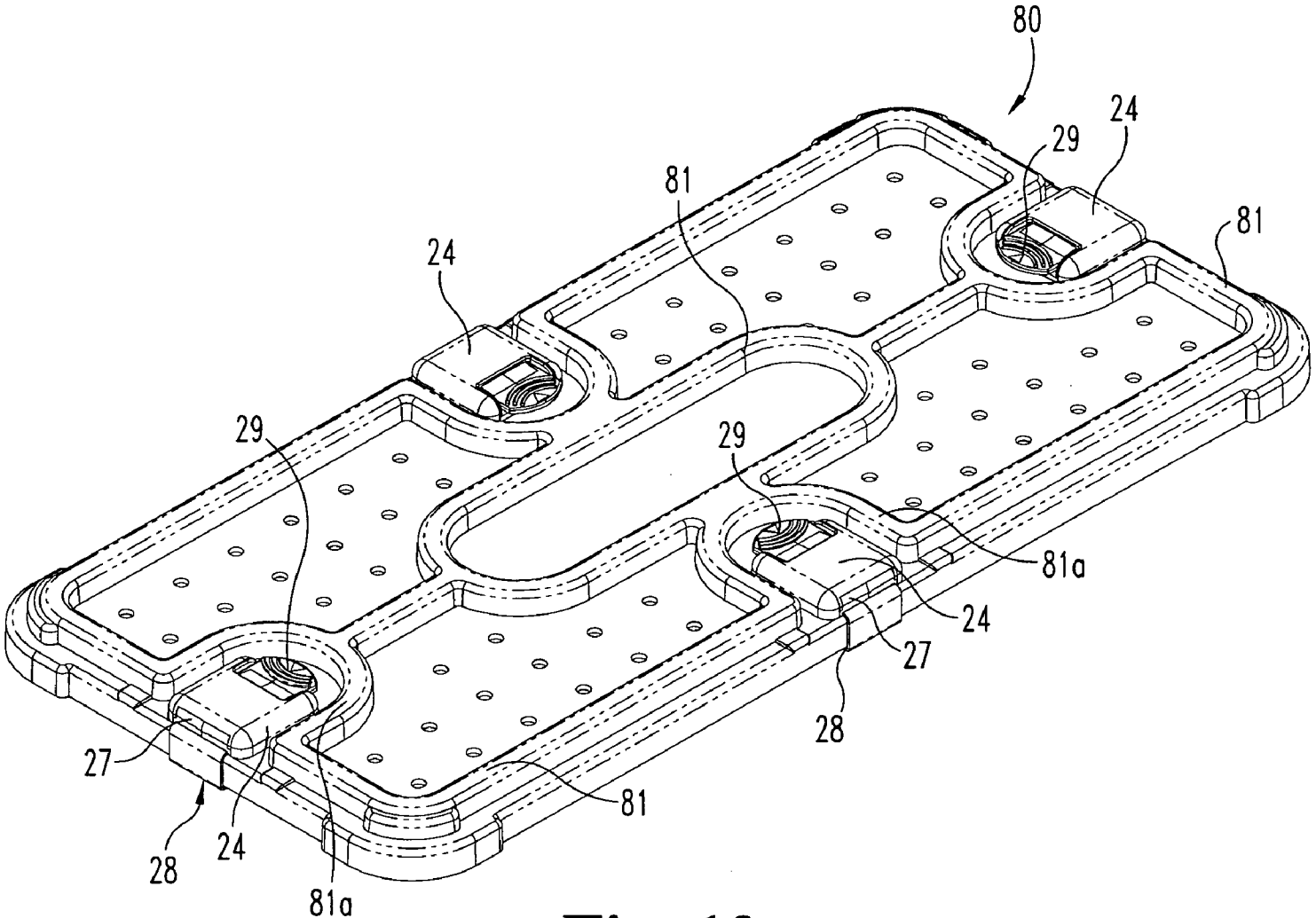
FIG. 19 is a perspective view of a closing lid including slide latches in a closed condition according to the present invention.
Figure 20:
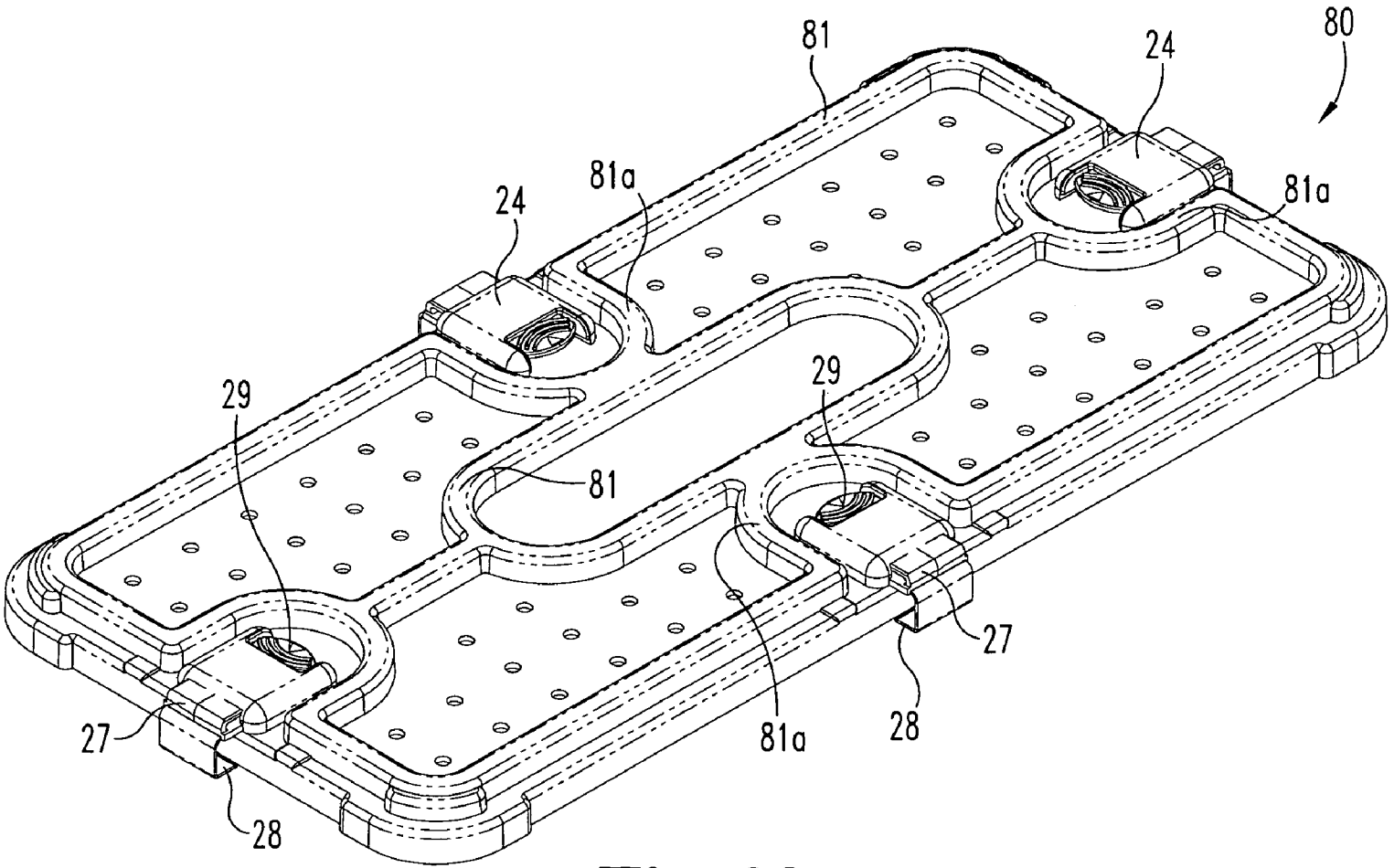
FIG. 20 is a perspective view of the FIG. 19 closing lid with the slide latches in an open condition.
Figure 21:
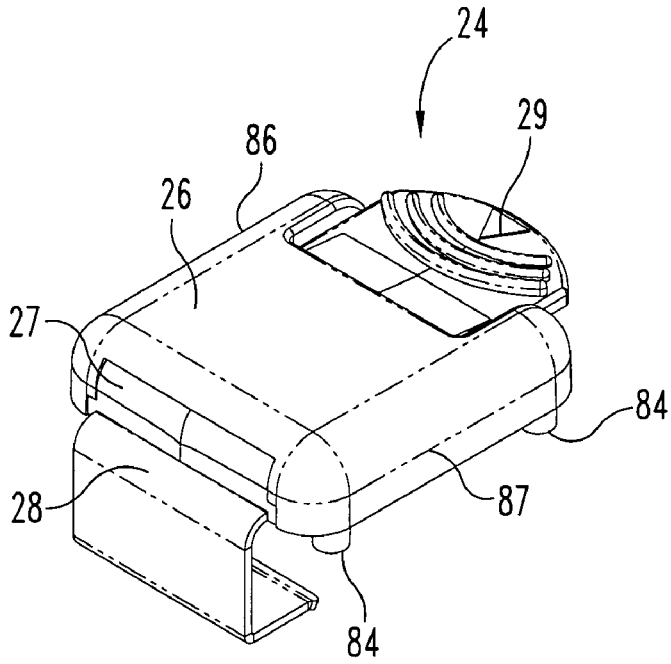
FIG. 21 is a perspective view of one slide latch in a closed condition.
Figure 22:
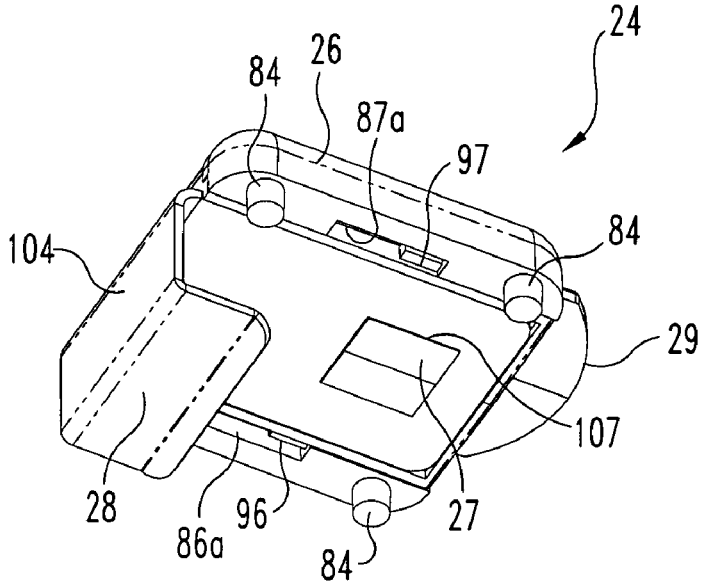
FIG. 22 is a perspective view of the FIG. 21 slide latch.
Figure 23:
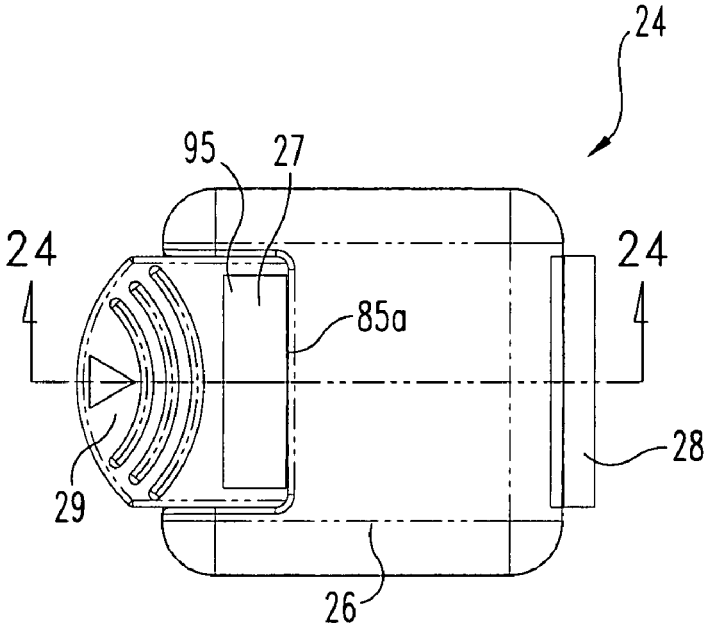
FIG. 23 is a top plan view of the FIG. 21 slide latch.
Figure 24:
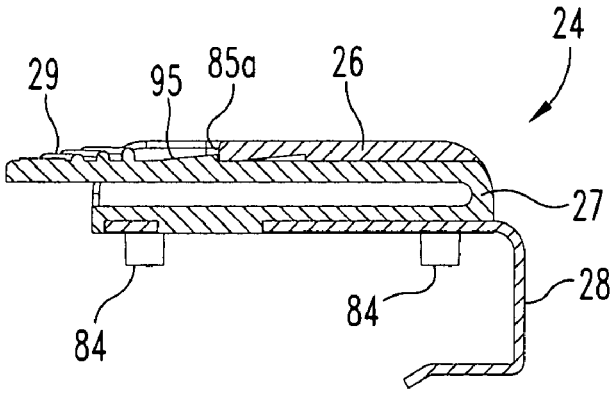
FIG. 24 is a side elevational view, in full section, of the FIG. 21 slide latch as viewed along line 24-24 in FIG. 23.
Figure 25:
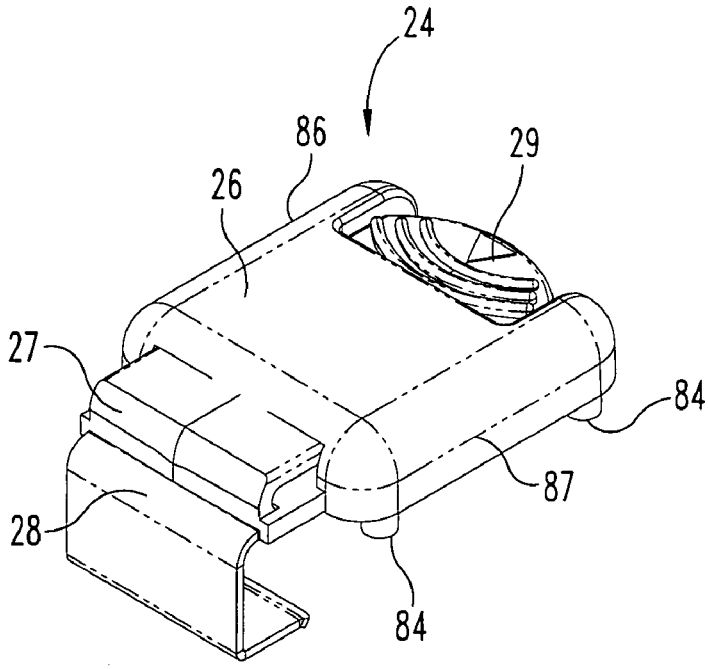
FIG. 25 is a perspective view of a slide latch in an open condition.
Figure 26:
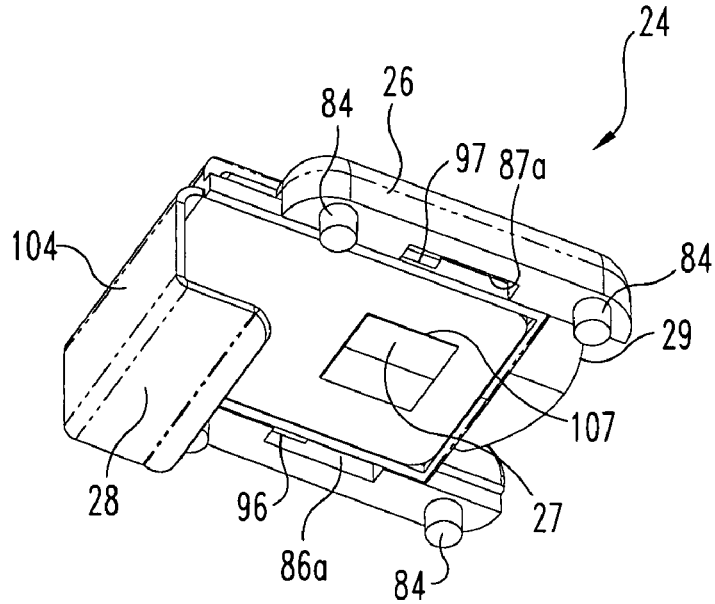
FIG. 26 is a perspective view of the FIG. 25 slide latch.
Figure 27:
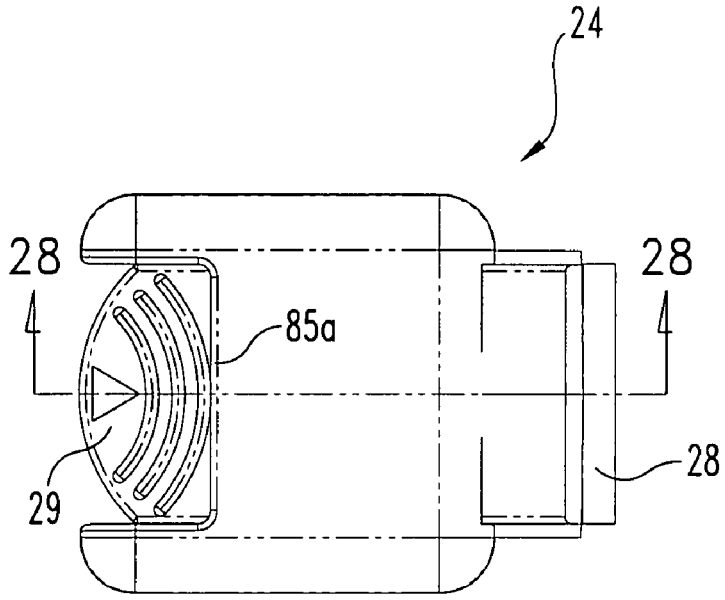
FIG. 27 is a top plan view of the FIG. 25 slide latch.
Figure 28:
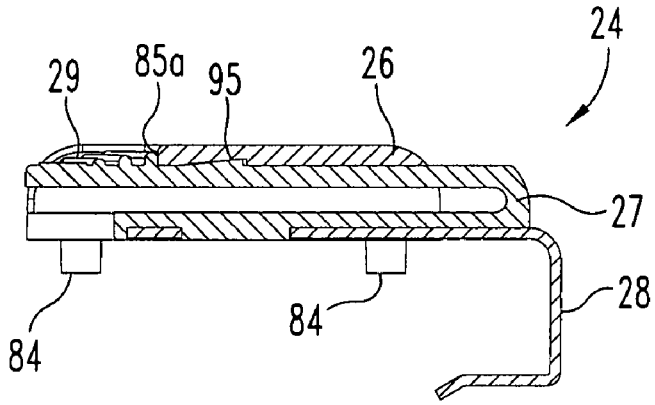
FIG. 28 is a side elevational view, in full section, of the FIG. 25 slide latch as viewed along line 28-28 in FIG. 27.

Referring to FIGS. 19 and 20, a slightly different closing lid 80 is illustrated with four slide latches 24. One reason to include closing lid 80 is to convey the understanding that the tray construction disclosed herein can be used in combination with closing lids of different styling and construction. The raised rib sections 81 of various dimensions and shapes provide structural rigidity to the molded plastic construction of lid 80. These structural rib sections 81 include a curved portion 81*a* disposed around the sides and the button end of each slide latch. These raised rib sections also provide a way of safely stacking completed cases on top of each other without putting weight on or interfering with the individual slide latches 24.

Consistent with what has been described for closing lid 21, each slide latch 24 includes a plastic body 26 that is ultrasonically welded to the surface of lid 80. The slide latches 24 of FIG. 19 are positioned in what constitutes a closed condition if assembled to a tray. In the illustrated position, the slide lid 28 is drawn inwardly toward the body of the lid 80 and would be received by a corresponding and cooperating slot 30 when the slide lip 28 is in this position and the lid is applied to a tray. In the FIG. 20 illustration, the slide member 27 has been moved outwardly so as to constitute an open condition if assembled to a tray. If lid 80 of FIG. 20 is assembled to a tray, each slide lip 28 is positioned outwardly and does not engage its corresponding and cooperating slot 30. In this condition, the lid 80 is able to be lifted off of the tray, i.e., to open the case.

Referring now to FIGS. 21-28, the details of slide latch 24 are illustrated, first in the closed condition of FIG. 19 (see FIGS. 21-24) and thereafter in the open condition of FIG. 20 (see FIGS. 25-28). As already described, each slide latch 24 includes a slide body 26, slide member 27, slide lip 28, and slide button 29 which is a part of the unitary slide member 27.

Preferably, the slide body 26 is molded as a unitary plastic component to enable the described ultrasonic welding to the plastic of the upper surface of the tray, either tray 21 or tray 80. The slide member 27, including slide button 29 as part of its unitary construction, is preferably molded from plastic. The slide lip 28 is a unitary component that can be fabricated from plastic, but preferably from metal.

Figure 29:
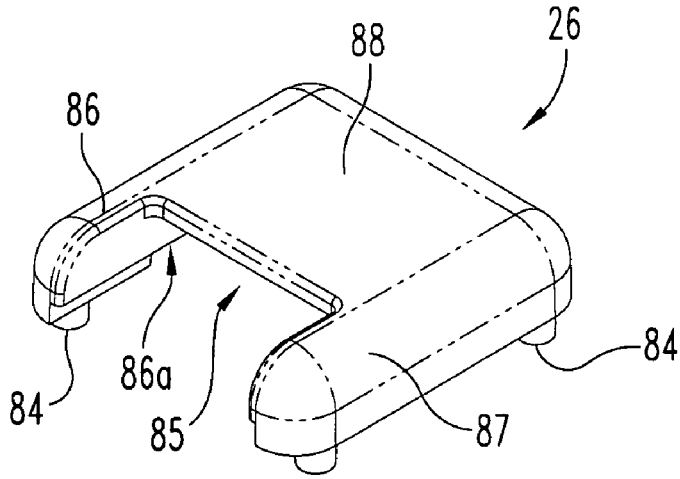
FIG. 29 is a perspective view of a slide latch body comprising one component part of the FIG. 21 slide latch.
Figure 30:
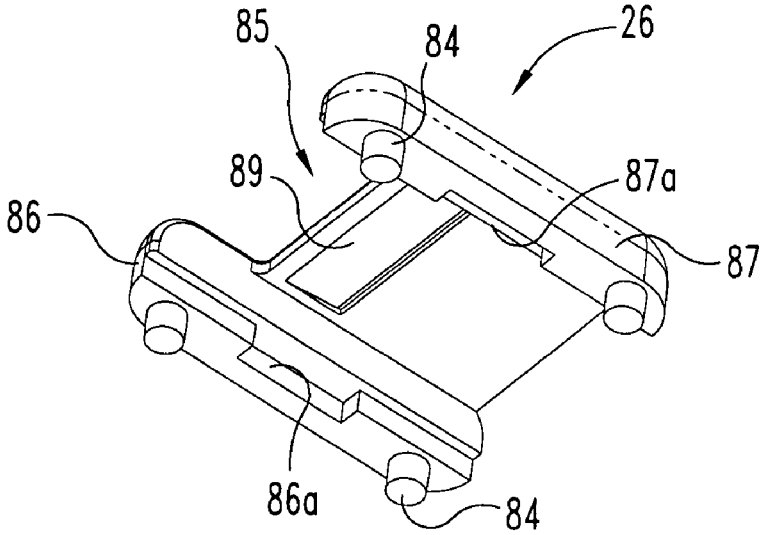
FIG. 30 is a perspective view of the FIG. 29 slide latch body.

With continued reference to FIGS. 21-24, the slide latch 24 in the closed condition is illustrated in greater detail. Slide latch body 26 (see FIGS. 29 and 30) includes four plastic spuds 84 for securely attaching the body 26 to the upper surface of the tray. The upper surface 25 includes a four-hole pattern at each slide latch location corresponding in size and spacing to the four spuds 84. Each spud is inserted into its corresponding hole. The end of each spud is ultrasonically melted into the countersunk underside of its corresponding hole to form a headed fastener similar to a rivet. Also included as part of the unitary construction of body 26 is a recessed opening 85, sides 86 and 87, upper panel 88, side notches 86*a* and 87*a*, and recessed ramp 89. Opening 85 includes a generally straight, inner abutment edge 85*a*.

Figure 31:
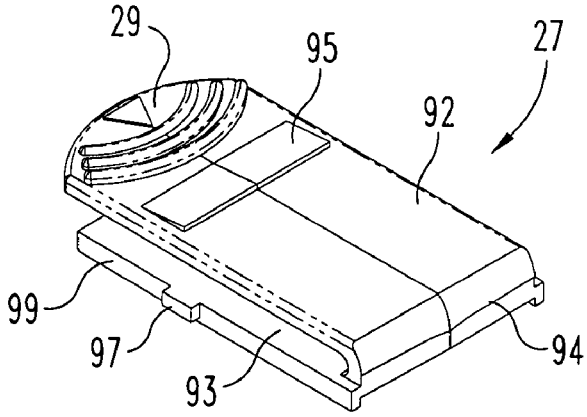
FIG. 31 is a perspective view of a slide member comprising one component part of the FIG. 21 slide latch.
Figure 32:
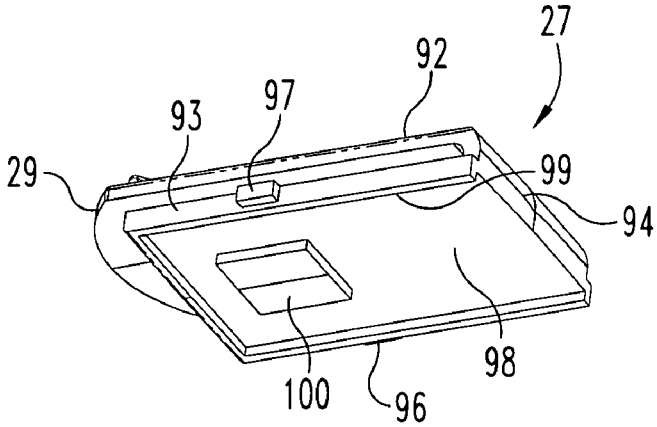
FIG. 32 is a perspective view of the FIG. 31 slide member.
Figure 33:
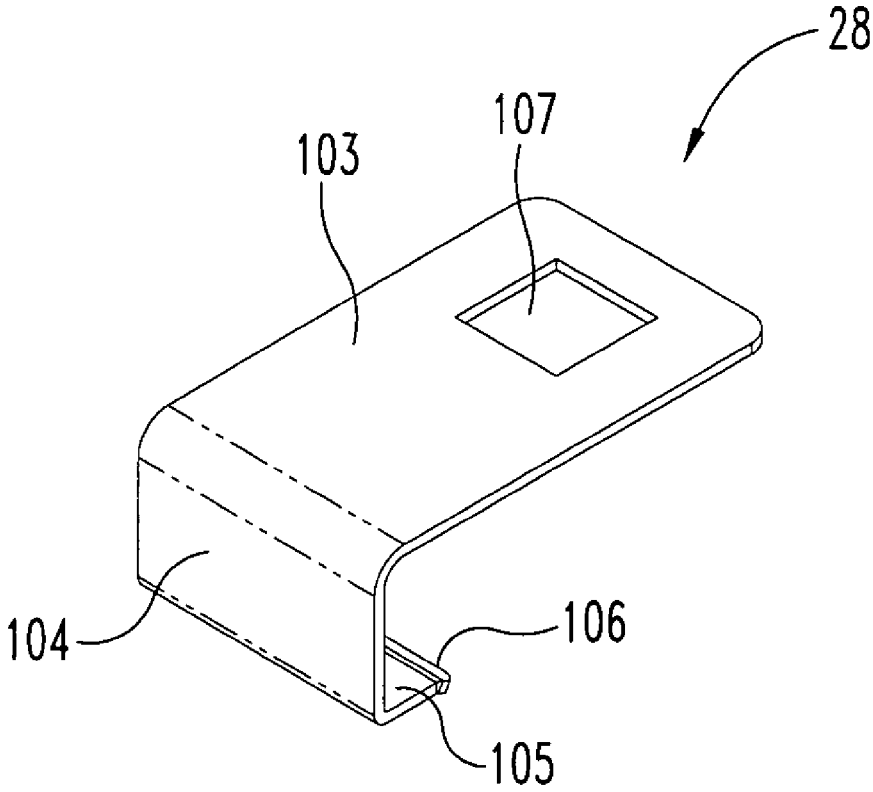
FIG. 33 is a perspective view of a slide lip comprising one component part of the FIG. 21 slide latch.

The slide member 27 fits within body 26 and the slide lip 28 is captured between the slide member 27 and the surface of the tray. The details of slide member 27 are illustrated in FIGS. 31 and 32. The details of slide lip 28 are illustrated in FIG. 33. As should be clear from the set of drawings, actuation of slide button 29 from a closed to open condition involves applying a slight downward force ("downward" being in the direction of the tray) with a pushing or sliding force in the direction of desired movement for slide lip 28. When moving the slide member 27 from the open to closed condition, the slight downward force on slide button 29 is not required, only the sliding force, as will be explained hereinafter.

Referring to FIGS. 31 and 32, unitary slide member 27 includes an upper panel 92 and a lower panel 93 that are flexibly connected together at hinge end 94. This construction allows upper panel 92 to flex downwardly in the direction of lower panel 93 and then spring back due to the flexibility and spring characteristics provided by the panel-to-panel integral (unitary) connection via hinge end 94. Upper panel 92 includes a raised portion 95 adjacent slide button 29. Portion 95 has a ramp shape with its lower end adjacent slide button 29. Lower panel 93 includes a pair of oppositely-disposed, outwardly-extending notch tabs 96 and 97. Lower panel 93 also includes a recessed area 98 inside of three-sided lip 99. Area 98 includes a generally square, raised portion 100.

Referring to FIG. 33, slide lip 28 includes an upper panel 103, outer end 104, and slot-receiving tab 105. Tab 105 includes an angled, inner edge 106. Upper panel 103 defines a generally square opening 107. While other opening shapes are permissible, opening 107 needs to be sized and shaped to receive raised portion 100 of slide member 27. By using a square shape for these interfitting portions, alignment in the X and Y directions can be easily maintained and precisely controlled. By providing a close fit with minimal clearance between opening 107 and portion 100, the movement of slide lip 28 is smooth and precise with no need to take up any noticeable slack before slide lip 28 movement begins in response to movement of the slide member 27.

Now with continued reference to FIGS. 21-28, it will be appreciated how the specific shapes of the three parts of slide latch 24 fit and interfit with each other for the movement of slide lip 28 from the closed condition of FIGS. 21-24 to the open condition of FIGS. 25-28 and back. In the starting closed condition, the raised portion 100 is received in square opening 107 such that sliding movement of slide member 27 translates into sliding movement of slide lip 28. The higher end of raised portion 95 is in abutment against inner edge 85*a*. Until this abutment is eliminated, the slide lip 28 does not change position and remains in its corresponding and cooperating tray slot 30. In this position, the closing lid 21 or 80 is securely retained to the tray so as to complete and provide a closed case.

When the slide button 29 is pushed downwardly, the described abutment is relieved and the slide member 27 is able to move outwardly, i.e., away from the edge of the tray. The downward force applied to slide button 29 only has to be maintained until the higher end of portion 95 clears edge 85*a*. Thereafter, portion 95 simply rides on the underside surface of upper panel 88 until the abutment face of recessed ramp 89 is contacted. This sets the desired open condition and the amount of movement between the two described abutment positions draws the slide lip 28 out of its corresponding and cooperating slot 30 so that the closing lid can be lifted off of the corresponding tray. In terms of the referenced corresponding tray, if a plurality of trays are stacked together, this would be the uppermost tray in that stack. If only a single tray is provided, then of course the corresponding tray is that single tray.

In order to move from an open condition back to a closed condition, depressing slide button 29 by pushing downwardly on it is not a required step since there is no abutment to be disengaged when moving in the reverse direction. Instead, the only manual manipulation of slide button 29 that is required is sliding motion due to the various ramp angles and directions of incline. As would be expected, there will be a "snap" when upper panel 92 pops up as portion 95 returns to its position in recessed opening 85. In order to avoid any risk of moving slide member 27 too far in either direction, notch tabs 96 and 97 slide in notches 86*a* and 87*a*, respectively. The fixed length of each slide notch with closed ends provides a positive stop, in each direction, if needed. As currently designed, the "proper" movement of slide member 27 is such that the notch tabs do not contact the ends of the corresponding side notches 86*a* and 87*a*.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A stackable containment tray assembly for receiving discrete articles, the assembly comprising:

a) a first stackable containment tray comprising a cooperatively arranged tray frame and floor combination;

b) a first upper stack ring attachable to the tray frame and comprising an upright wall, an inner support shelf on one side of the upright wall, an outer support shelf on an opposite side of the upright wall, and a depending outer wall;

c) a second upper stack ring attachable to the first upper stack ring and comprising an upright wall, an inner support shelf on one side of the upright wall, an outer support shelf on an opposite side of the upright wall, and a depending outer wall; and d) wherein the depending outer wall of the second upper stack ring is constructed and arranged to receive the upright wall of the first upper stack ring.

2. The stackable containment tray assembly, of claim 1 wherein the tray frame includes opposite ends with a bail handle attached to each end of the tray frame.

3. The stackable containment tray assembly of claim 2 which further includes a handle lock bracket attached to each end of the tray frame.

4. The stackable containment tray assembly of claim 3 wherein each handle lock bracket is constructed and arranged with a defined clearance channel and wherein each clearance channel is constructed and arranged to receive a portion of a corresponding bail handle of an adjacent lower stackable containment tray of a stacked combination.

5. The stackable containment tray assembly of claim 1 wherein the first and second upper stack rings are each unitary, molded plastic components.

6. The stackable containment tray assembly of claim 1 wherein the first and second upper stack rings have substantially the same construction.

7. The stackable containment tray assembly of claim 1 including a lower stack ring that is attachable to the tray frame and floor combination.

8. The stack ring of claim 1 wherein the depending outer wall of the second upper stack ring is stackable onto the outer support shelf of the first upper stack ring.

9. The stackable containment tray assembly of claim 1 wherein either a closing lid or a second tray frame is attachable to the upright wall of the second upper stack ring.

10. The stackable containment tray assembly of claim 1 wherein the distance between an outer surface of the upright wall of the first stack ring and an outer surface of the depending outer wall of the second upper stack ring is substantially equal to a thickness of the depending outer wall.

11. The stackable containment tray assembly of claim 7 wherein the lower stack ring comprises an upright wall, an inner support shelf on one side of the upright wall, an outer support shelf on an opposite side of the upright wall, and a depending outer wall.

12. The stack ring of claim 1 wherein the depending outer wall of the first lower stack ring is stackable onto the outer support shelf of the second lower stack ring.

13. A stackable containment tray assembly, comprising:

a) a first stackable containment tray comprising a cooperatively arranged tray frame and floor combination;

b) a first upper stack ring attachable to the tray frame and comprising an upright wall, an inner support shelf on one side of the upright wall, an outer support shelf on an opposite side of the upright wall, and a depending outer wall;

c) a second upper stack ring attachable to the first upper stack ring and comprising an upright wall, an inner support shelf on one side of the upright wall, an outer support shelf on an opposite side of the upright wall, and a depending outer wall, wherein the depending outer wall of the second upper stack ring is constructed and arranged to receive the upright wall of the first upper stack ring;

d) a lower stack ring attachable to the tray frame and floor combination; and e) a closing lid attachable to the upright wall of the second upper stack ring.

14. The stackable containment tray assembly of claim 13 wherein the closing lid includes at least one slide latch, each slide latch having a lip portion received by the one stackable containment tray.

15. The stackable containment tray assembly of claim 13 wherein the tray frame includes opposite ends and which further includes a bail handle attached to each end of the tray frame.

16. The stackable containment tray assembly of claim 15 which further includes a handle lock bracket attached to each end of the tray frame.

17. The stackable containment tray assembly of claim 16 wherein each handle lock bracket is constructed and arranged with a defined clearance channel and wherein each clearance channel is constructed and arranged to receive a portion of a corresponding bail handle of an adjacent lower stackable containment tray of a stacked combination.

18. The stackable containment tray assembly of claim 13 wherein the first and second upper stack rings are each unitary, molded plastic components.

19. The stackable containment tray assembly of claim 13 which further includes a second stackable containment tray, the first stackable containment tray being stacked onto the second stackable containment tray with the lower stack ring intermediate the first and second containment trays.

20. The stackable containment tray assembly of claim 19 wherein the second stackable containment tray includes a bail handle and the first stackable containment tray includes a handle lock bracket, the first stackable containment tray and the second stackable containment tray being interconnected by insertion of a portion of the bail handle into a portion of the handle lock bracket.

21. A stackable containment tray assembly for receiving discrete articles, the assembly comprising:

a) a first containment tray comprising a cooperatively arranged tray frame and floor combination;

b) an upper stack ring attachable to the tray frame;

c) a first lower stack ring attachable to the tray frame and floor combination and comprising an upright wall, an inner support shelf on one side of the upright wall, an outer support shelf on an opposite side of the upright wall, and a depending outer wall; and d) a second lower stack ring attachable to the first lower stack ring and comprising an upright wall, an inner support shelf on one side of the upright wall, an outer support shelf on an opposite side of the upright wall, and a depending outer wall; and e) wherein the depending outer wall of the first lower stack ring is constructed and arranged to receive the upright wall of the second lower stack ring.

22. The stackable containment, tray assembly of claim 21 wherein the distance between an outer surface of the upright wall of the second lower stack ring and an outer surface of the depending outer wall of the first lower stack ring is substantially equal to a thickness of the depending outer wall.

23. A containment case for receiving discrete articles comprising: one stackable containment tray that is assembled from separate component parts, the one stackable containment tray including:

a) a cooperatively arranged tray frame and floor combination;

b) an upper stack ring attached to the tray frame; and c) a lower stack ring attached to the tray frame and floor combination, wherein the upper stack ring of the stackable containment tray is constructed and arranged to receive a lower stack ring of an adjacent stackable containment tray for the stacking of one stackable containment tray on top of another stackable containment tray; and d) a closing lid assembled to the one stackable containment tray, wherein the closing lid includes at least one slide latch having a lip portion received by the one stackable containment tray.

* * * * *

UNITED STATES PATENT AND TRADEMARK OFFICE

CERTIFICATE OF CORRECTION

PATENT NO. : 7,905,353 B2
APPLICATION NO. : 11/725532
DATED : March 15, 2011
INVENTOR(S) : Baker et al.

It is certified that error appears in the above-identified patent and that said Letters Patent is hereby corrected as shown below:

Column 1 delete the paragraph spanning lines 7-11:

"The present application is a Continuation-In-Part patent application of and claims the benefit of U.S. Provisional Patent Application Ser. No. 60/818,207, filed Jun. 30, 2006, entitled "Stackable Containment Trays" which is hereby incorporated by reference in its entirety."

Column 1 line 7 insert the following paragraph:

--This application claims the benefit of U.S. Provisional Patent Application Ser. No. 60/818,207, filed Jun. 30, 2006, entitled "Stackable Containment Trays" which is hereby incorporated by reference in its entirety.--

Signed and Sealed this
Tenth Day of July, 2012

David J. Kappos

David J. Kappos
*Director of the United States Patent and Trademark Office*